US007228919B2

(12) United States Patent
Fehres et al.

(10) Patent No.: US 7,228,919 B2
(45) Date of Patent: Jun. 12, 2007

(54) PIVOTING PIPE HANDLER FOR OFF-LINE MAKE UP OF DRILL PIPE JOINTS

(75) Inventors: Neil E. Fehres, Sugarland, TX (US); Thomas A. Yost, Houston, TX (US)

(73) Assignee: National-Oilwell, L.P., Houston, TX (US)

( * ) Notice: Subject to any disclaimer, the term of this patent is extended or adjusted under 35 U.S.C. 154(b) by 0 days.

(21) Appl. No.: 11/252,492

(22) Filed: Oct. 18, 2005

(65) Prior Publication Data

US 2006/0081379 A1 Apr. 20, 2006

Related U.S. Application Data

(60) Provisional application No. 60/620,049, filed on Oct. 19, 2004.

(51) Int. Cl.
*E21B 19/10* (2006.01)

(52) U.S. Cl. ..... 175/85; 166/380

(58) Field of Classification Search ..... 175/85; 166/380, 77.1; 414/22.65, 22.67
See application file for complete search history.

(56) References Cited

U.S. PATENT DOCUMENTS 5,107,940 A * 4/1992 Berry ..... 175/85
2005/0126827 A1* 6/2005 Berry ..... 175/85

OTHER PUBLICATIONS

PCT Search Report and Written Opinion, dated Oct. 20, 2006. PCT Application No. PCT/US05/37353, filed Oct. 18, 2005.

* cited by examiner

*Primary Examiner*—William P. Neuder
(74) *Attorney, Agent, or Firm*—Howrey LLP

(57) ABSTRACT

An apparatus and method for use in the off-line make-up of drill pipe stands on drilling rigs used in the exploration and production of oil and gas reserves are disclosed. The disclosed invention is a pipe handling system in which a section of the V-door ramp attached to a drilling rig structure pivots to allow one or more joints of drill pipe to be placed in a vertical position. Through use of an off-line roughneck in conjunction with an off-line drill pipe elevator, the joints of drill pipe held in the vertical position via the pivoting pipe handler of the present invention can be connected together, connected to additional joints of drill pipe, and placed in a racking board to be stored until they are subsequently connected to the drill string. The use of the pivoting pipe handler of the present invention allows stands of drill pipe to be "made-up" without the need to interrupt drilling operations and, thus, significantly reduces the amount of time required to drill a borehole.

50 Claims, 5 Drawing Sheets

PIVOTING PIPE HANDLER FOR OFF-LINE MAKE UP OF DRILL PIPE JOINTS

This application claims the benefit of U.S. Provisional Application No. 60/620,049, filed Oct. 19, 2004.

FIELD OF THE INVENTION

The present invention relates to a pipe handling system for use in the off-line make-up of drill pipe stands that are used in the exploration and production of oil and gas reserves. In particular, the invention relates to a unique pipe handling system in which a section of the V-door ramp attached to a drilling rig structure pivots to allow one or more joints of drill pipe to be placed in a vertical position for off-line make-up with additional joints of drill pipe.

BACKGROUND OF THE INVENTION

In the conventional drilling of an oil and gas well, a series of drill pipe joints (each joint approximately 30 feet in length) are connected together to form the drill string used in the drilling of a well bore. As the drilling operation proceeds, more and more drill pipe joints must be connected together and lowered into the borehole. For deeper wells, it may be necessary to connect literally hundreds of pipe joints together to drill the well bore to the depth of the producing zone.

The drill pipe joints are typically coupled together using threaded connections, known as tool joints, in which the male end, or pin member, of one pipe joint is threadably connected to the female end, or box member, of an adjacent pipe joint. The process of threadably coupling adjacent pipe joints together is a time consuming process that requires a significant amount of pipe handling by the drilling rig's crew.

Specifically, in a typical rotary table drilling operation, a drill bit is placed on the downward end of the drill string. Drill collars—which are essentially thick-walled sections of drill pipe—are connected together to form the bottom hole assembly section of the drill string. The drill collars are used to provide sufficient weight on the drill bit as the drill bit is rotated in the borehole to drill deeper. To rotate the drill string in the borehole, a top drive unit may be used to provide the rotational force to the drill string. Top drive units are connected between the swivel and the crown block in the mast.

Each time drilling has proceeded far enough to require that a new drill pipe joint be added to the drill string, it is necessary (1) to stop rotation of the drill string, (2) to support the drill string in the borehole, as with slips, (3) to detach the top drive from the upper pipe joint of the drill string, (4) to attach the top drive to the upper end of a new pipe joint to be added to the drill string, and (5) to make-up the threaded connection between the upper joint of the drill string and the new joint of drill pipe—through use of manually operated tongs or an iron roughneck. Once the new pipe joint has been added to the drill string, the drill string is rotated again and drilling is resumed. As the borehole depth increases, the process of adding a new joint of drill pipe is repeated until the drill string reaches the desired well bore depth.

As the general description above shows, rotation of the drill string (and, thus, drilling of the borehole) must cease and the rotating equipment must be disconnected from the drill string in the borehole each time it is necessary to make-up a new joint of drill pipe to the drill string. The making-up of the drill string is thus a time consuming process that limits the amount of new hole that can be drilled in a single day. Given the expense of drilling operations, it is desirable, and in the case of a deep well essential, to minimize the time required to drill the well bore.

Further, it should be noted that the making-up of the drill string requires a substantial amount of drill pipe handling by the drilling rig crew. Given the equipment used to make-up the drill string, the size and weight of the pipe joints used, and the time pressure under which the drilling crew operates, the substantial amount of pipe handling required to drill the well bore provides ample opportunity for injury to the drilling rig personnel.

In an effort to reduce the amount of time required to make-up the drill string and, ultimately, to drill the well bore, drilling rig manufacturers have begun to design rigs with the ability to make-up "stands" of drill pipe "off-line"—i.e., to make-up joints of drill pipe with equipment other than the main drilling equipment. These drill pipe stands typically consist of two, three, or even four pipe joints threadably connected together. The size of the drill pipe stands that can be assembled off-line is primarily dependent on the size of the drilling rig's mast or derrick (hereinafter collectively referred to as "mast").

After being assembled, these stands can be stored in racking boards attached to and extending outwardly from the drilling rig's mast. When additional pipe joints are needed for continued drilling operations, these pipe stands can be connected to the drill string. In this way, two, three, or four additional pipe joints can be connected to the drill string through a single make-up using the main drilling equipment.

Although prior art off-line pipe make-up systems provide the ability to make-up stands of drill pipe off-line, the prior art systems still require a significant amount of pipe handling by the drilling rig crew. The prior art systems typically require two "off-line holes", equivalent to the mousehole in the drilling rig, for placement of the drill pipe joints prior to make-up. Specifically, in the prior art systems, a first joint of drill pipe is lifted from the V-door ramp of the drilling rig and placed in a first off-line hole in a platform attached to the drilling rig that supports an off-line roughneck. A second joint of drill pipe is then lifted from the V-door ramp and placed in a second off-line hole in the off-line roughneck platform. A third joint of drill pipe is then lifted from the V-door ramp and swung into engagement with the first joint of drill pipe—which is positioned in the off-line hole closest to the offline roughneck. The two joints are then made up using the off-line roughneck, lifted above the off-line roughneck, and swung into position above the third pipe joint. In similar fashion, the two connected joints are made up with the third joint in the second off-line hole. The drill pipe stand is then lifted from the off-line roughneck and positioned in a racking board for subsequent use.

As the preceding general description shows, the prior art off-line make-up systems require a significant amount of pipe handling by the drilling rig's crew. Further, the prior art systems require off-line holes that are potential hazards to the rig crew performing the off-line make-up operations.

The present invention is designed to address these and other known problems with the prior art systems. What is needed is an apparatus and method for off-line make-up of drill pipe stands that allows for less pipe handling by a drilling rig's crew and, thus, allows for a safer and more efficient off-line make-up operation. It is an object of the present invention to provide such an apparatus and method for off-line make-up of drill pipe stands. Those and other objectives will become apparent to those of skill in the art from a review of the specification below.

SUMMARY OF THE INVENTION

An apparatus and method for use in the off-line make-up of drill pipe stands on drilling rigs used in the exploration and production of oil and gas reserves. The disclosed invention is a unique pipe handling system in which a section of the V-door ramp attached to a drilling rig structure pivots to allow one or more joints of drill pipe to be placed in a vertical position for off-line make-up with additional joints of drill pipe. A support cylinder connecting the pivoting section to the drilling rig structure supports the pivoting section in the horizontal position. After a pipe joint is rolled onto the pivoting section of the V-door ramp, the support cylinder retracts, thereby allowing the pivoting section of the V-door ramp to pivot downwardly until the pipe joint is in the vertical position. The pipe joint is maintained in the vertical position within the pivoting section of the V-door ramp by a holding means. Further, while in the vertical position, the pipe joint can be raised or lowered to the proper position through the use of a cylinder located in the pivoting section.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

FIG. 1 also shows two racking boards attached to and extending outwardly from the drilling rig's mast.

DESCRIPTION OF ILLUSTRATIVE EMBODIMENTS

The following examples are included to demonstrate preferred embodiments of the invention. It should be appreciated by those of skill in the art that the techniques disclosed in the examples that follow represent techniques discovered by the inventors to function well in the practice of the invention, and thus can be considered to constitute preferred modes for its practice. However, those of skill in the art should, in light of the present disclosure, appreciate that many changes can be made in the specific embodiments that are disclosed and still obtain a like or similar result without departing from the spirit and scope of the invention.

Figure 1:
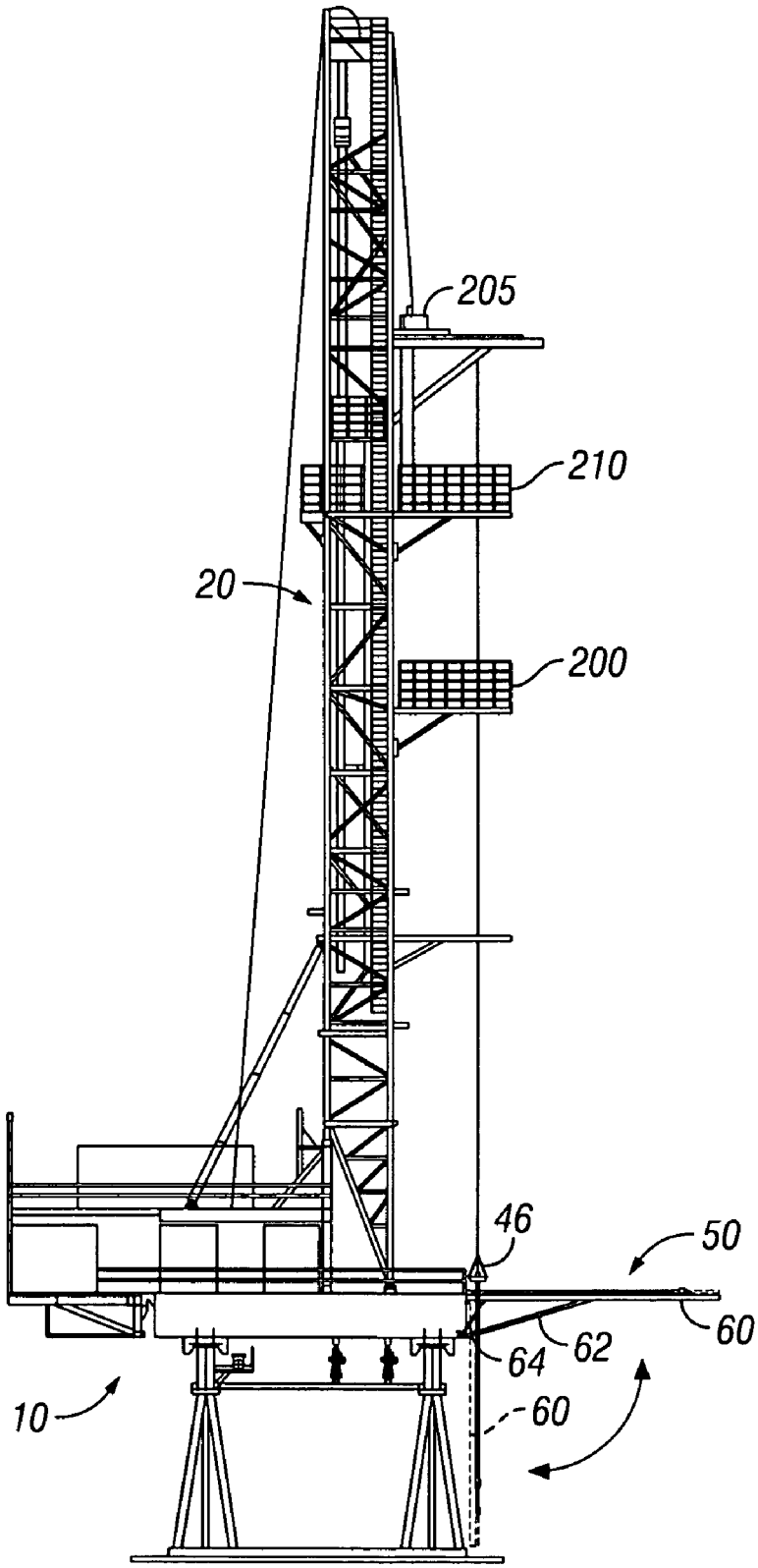
FIG. 1 is a side view of a typical drilling rig structure showing a V-door ramp in accordance with one embodiment of the present invention connected to the drilling rig structure.

Referring to FIG. 1, a V-door ramp 50 is shown connected to a drilling rig structure 10. Drilling rig structure 10 can be either a land based drilling rig or an offshore drilling rig. As discussed in more detail with reference to FIGS. 2 through 6, V-door ramp 50 is comprised of two sections—stationary section 55 and pivoting section 60. Stationary section 55 is supported in the horizontal position as shown in FIG. 1 by support member 62 that is connected between V-door ramp 50 and rig structure 10. One of skill in the art will appreciate that depending on the size of the stationary section 55 of V-door ramp 50 and the number of drill pipe joints that will be supported on the stationary section 55, a plurality of support members 62 may be necessary to support the combined weight of stationary section 55 and the drill pipe joints. Further, although a horizontal V-door ramp 50 is shown in FIG. 1, V-door ramp 50 can be a "slanted" ramp that is connected on one end to rig structure 10 while the other end slants diagonally toward the ground (if used on a land based drilling rig) or toward a lower, pipe deck (if used on an offshore drilling rig). One of skill in the art will appreciate that the objectives of the present invention can be obtained whether V-door ramp 50 is a horizontal ramp or a slanted ramp.

Pivoting section 60 of V-door ramp 50 is shown in FIG. 1 in both the horizontal position (solid lines) and in the vertical position (dashed lines). As discussed in more detail with reference to FIGS. 4 through 6, pivoting section 60 is supported in both the horizontal and vertical positions by support cylinder 64. If V-door ramp 50 is a slanted ramp (as discussed in the preceding paragraph), pivoting section 60 will be sized such that it can pivot from the slanted position to the vertical position as required to achieve the objectives of the present invention.

FIG. 1 also shows two racking boards—200 and 210—attached to the mast 20 of the rig structure 10. Racking board 200 is used to store, or "rack", stands of drill pipe that consist of three joints of drill pipe connected together and, thus, measure approximately 90 feet in length. Similarly, Racking board 210 is used to rack stands of drill pipe that consist of four joints of drill pipe connected together and, thus, measure approximately 120 feet in length. Although not shown in FIG. 1, a lower racking board may be attached to the drilling rig mast to rack stands of drill pipe that consist of two joints of drill pipe connected together and, thus, measure approximately 60 feet in length. One of skill in the art will appreciate that the size of the drill pipe stands to be made-up using the present invention will depend primarily on the size of the drilling rig's mast.

Figure 2:
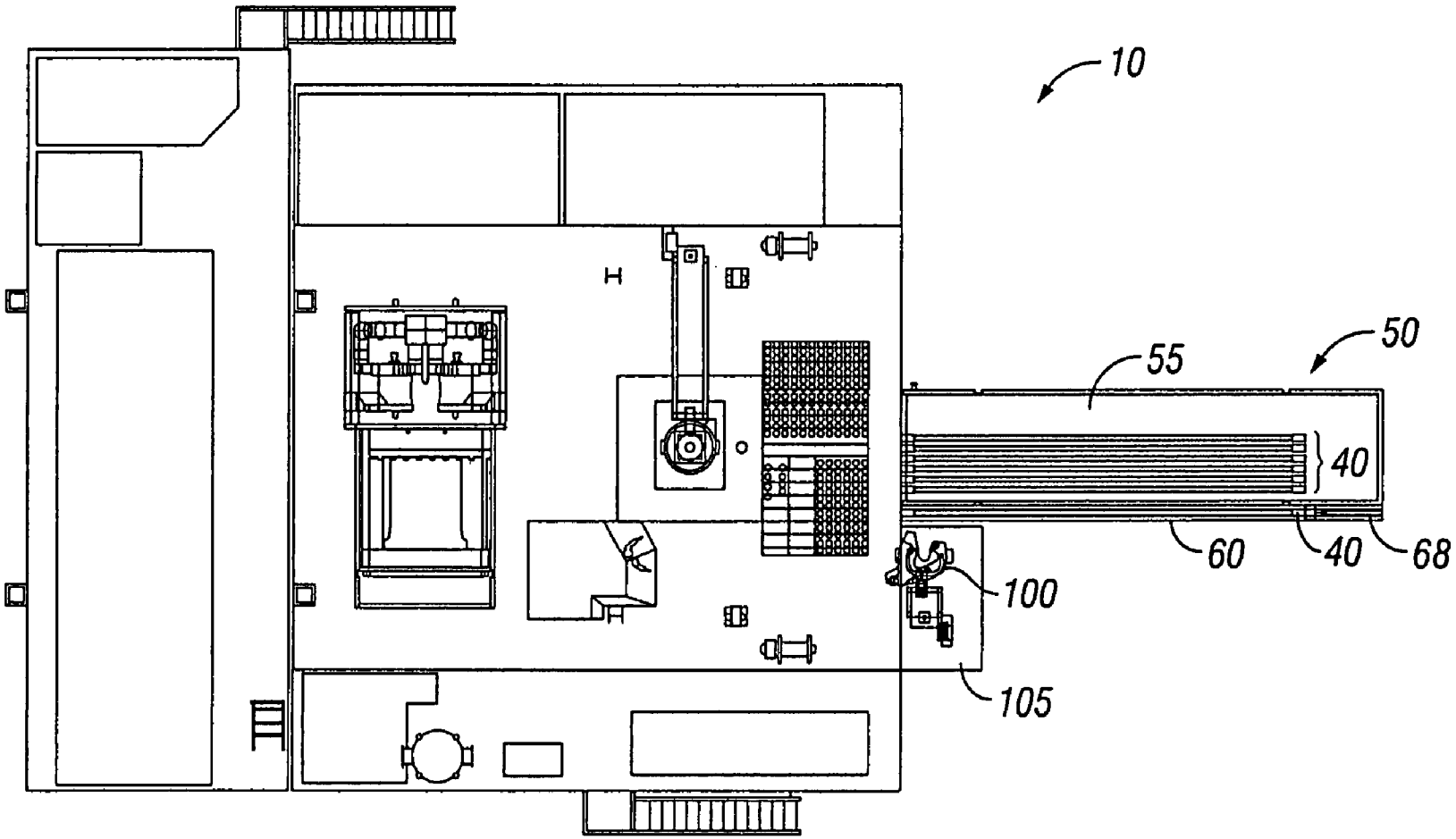
FIG. 2 is a top view of the drilling rig's floor showing the V-door ramp in accordance with one embodiment of the present invention connected to the drilling rig structure.
Figure 3:
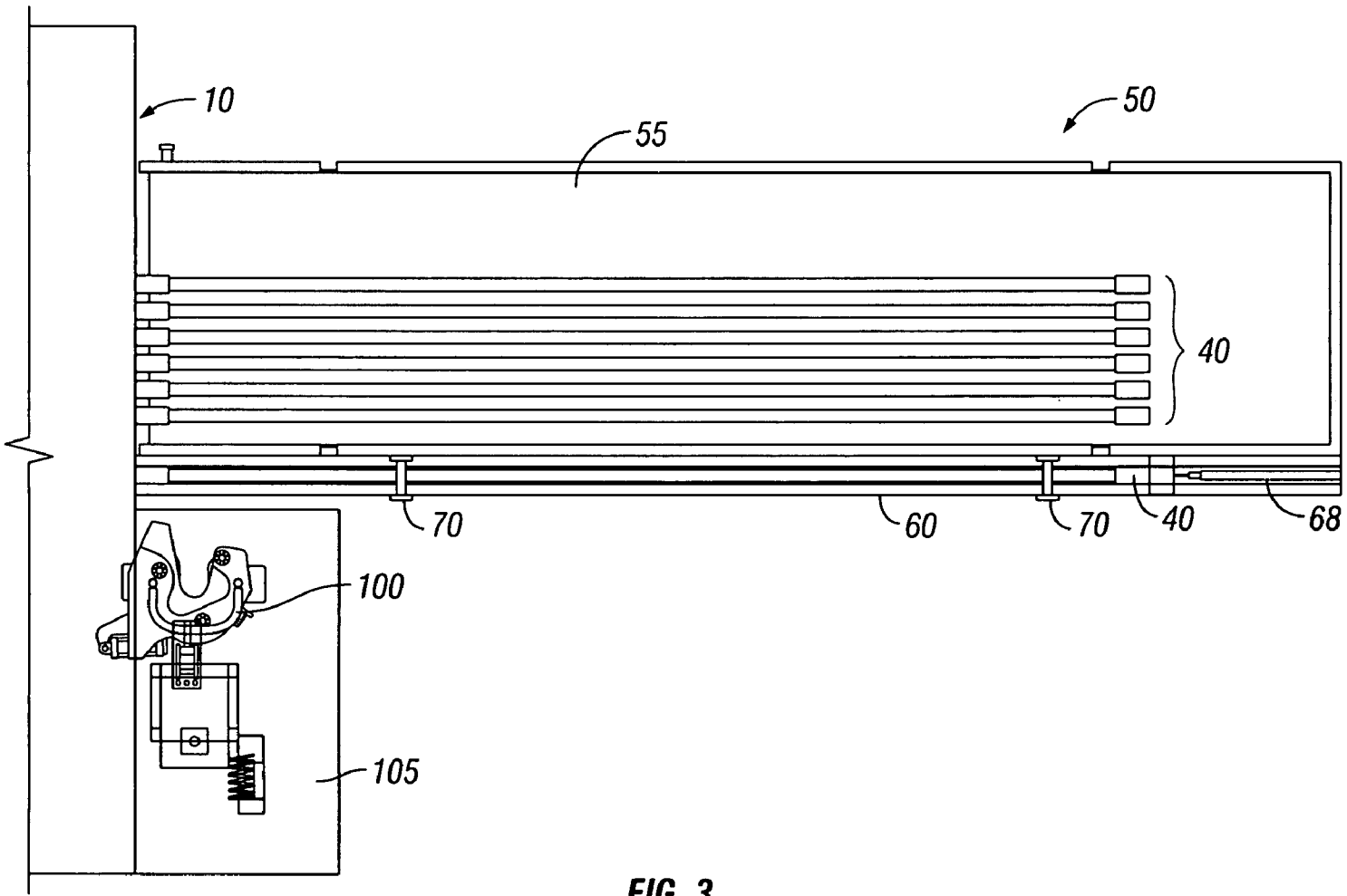
FIG. 3 is a close-up top view of the V-door ramp showing the stationary section and the pivoting section of the V-door ramp in accordance with one embodiment of the present invention.

FIG. 2 is a top view of the rig floor of rig structure 10 showing V-door ramp 50 attached to rig structure 10. As shown in FIG. 2, V-door ramp 50 consists of stationary section 55 and pivoting section 60. V-door ramp 50 is used to support the individual pipe joints 40 that are used to make-up the drill string during drilling operations. FIG. 2 also shows positioning cylinder 68 within pivoting section 60 used for positioning pipe joint(s) 40 vertically at the proper height during the off-line make-up operation (as discussed in more detail with reference to FIGS. 3 through 6). Additionally, FIG. 2 shows off-line roughneck 100 mounted on an elevated platform 105 that is connected to rig structure 10 near V-door ramp 50.

Functioning of the Pivoting Pipe Handler

Having identified the components of the pivoting pipe handler of the present invention, the functioning of the present invention will be described with reference to FIGS. 3 through 6. Specifically, with reference to FIG. 3, pipe joints 40 are shown supported in the horizontal position by stationary section 55 and pivoting section 60 of V-door ramp 50. During drilling operations, pipe joints 40 will be lifted from a storage area on the ground at the drill site and placed on V-door ramp 50 for holding just prior to use.

As drilling operations proceed, the borehole will be drilled using the main drilling equipment of rig structure 10 (as discussed previously). While the main drilling equipment drills the borehole, crew members can prepare for the connection of additional pipe joints to the drill string using the off-line make-up system of the present invention. As noted, 60-foot drill pipe stands, 90-foot drill pipe stands, or 120-foot drill pipe stands can be assembled using the off-line make-up system of the present invention. One of skill in the art will appreciate, however, that if the mast of a drilling rig increases in size, it is possible that even longer stands may be assembled using the off-line make-up system of the present invention.

Depending on the size of the drill pipe stand to be made-up, pivoting section 60 of V-door ramp 50 can be sized to hold either one or two joints of drill pipe. For off-line make-up of a 60-foot stand of drill pipe, pivoting section 60 can be sized to hold one pipe joint 40. For off-line make-up of a 90-foot (or longer) stand of drill pipe, pivoting section 60 can be sized to hold two pipe joints 40. One of skill in the art will appreciate that additional embodiments exist wherein pivoting section 60 can be sized to hold three or even four pipe joints 40 depending on the size of the drill pipe stands to be assembled off-line.

With reference to FIGS. 3 through 6, the assembly of a drill pipe stand using the present invention will now be described. To assemble a 90-foot drill pipe stand using the present invention, two pipe joints 40 are rolled from stationary section 55 of V-door ramp 50 onto pivoting section 60. A holding means 70 is then "closed" over the pipe joints 40. In a preferred embodiment, the holding means 70 comprises a hinged bar that is attached to one side of pivoting section 60 such that the bar can be "swung" over the top of the pipe joints 40 into a latching mechanism on the opposite side of pivoting section 60. When in position over the top of the pipe joints 40, the holding means 70 maintains the pipe joints 40 in the vertical position when pivoting section 60 is pivoted downwardly. The holding means 70 can be either automatically "triggered" to close over the top of pipe joints 40 when they are rolled onto pivoting section 60, or it can be manually closed over the top of the pipe joints 40 by members of the drilling rig crew.

Figure 4:
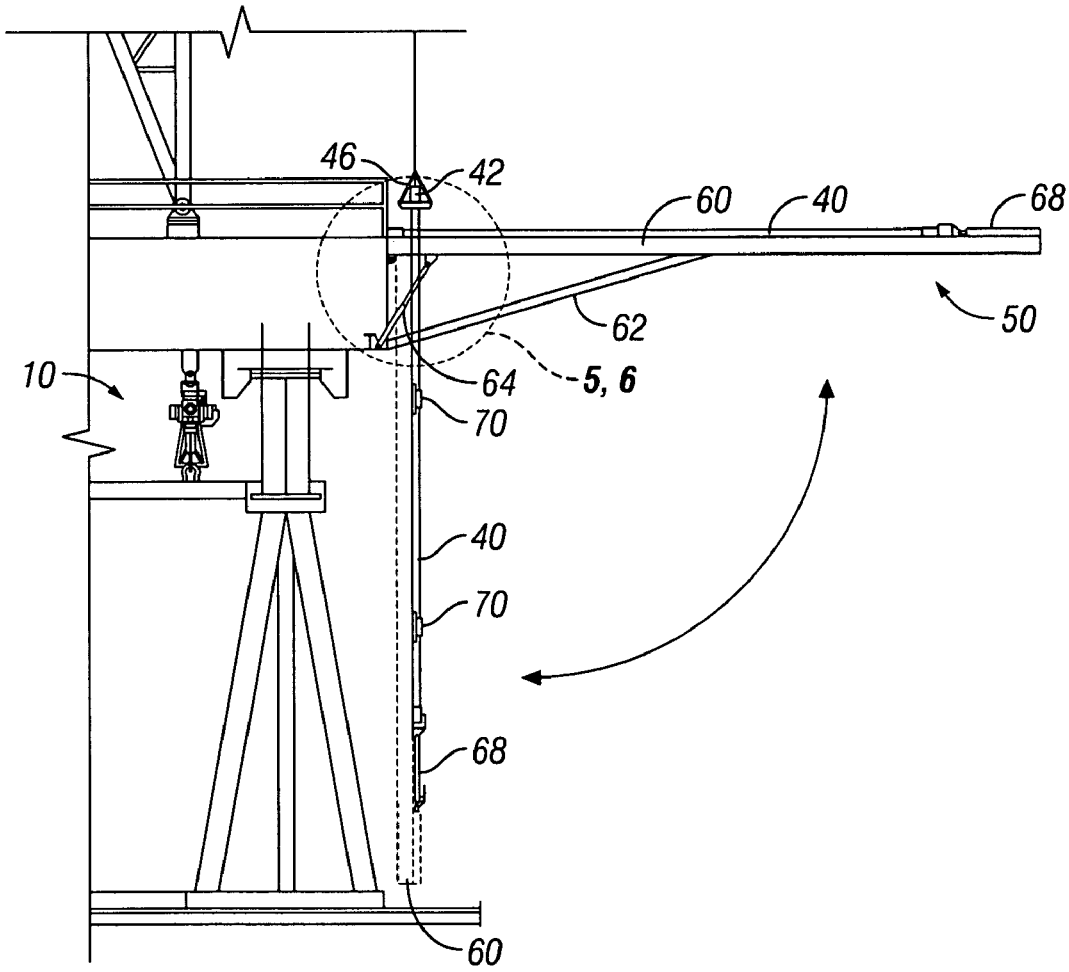
FIG. 4 is a close-up side view of the V-door ramp showing the stationary section and the pivoting section of the V-door ramp in accordance with one embodiment of the present invention.

As shown in FIG. 4, after the pipe joints 40 are placed in pivoting section 60 and the holding means is closed over the top of the pipe joints 40, pivoting section 60 is pivoted downwardly until the pipe joints 40 are in the vertical position. The holding means prevents the pipe joints 40 from falling out of pivoting section 60 when in the vertical position. Positioning cylinder 68 is used to raise or lower the pipe joints 40 to the proper position for connection to off-line roughneck 100.

While the two pipe joints 40 are being rolled into position onto pivoting section 60 and are being pivoted downwardly, a third pipe joint 40 is lifted from the stationary section 55 of V-door ramp 50 and raised above the area around platform 105 and V-door ramp 50. The third pipe joint 40 is lifted from the stationary section 55 of V-door ramp 50 by connecting tool joint 42 of the third pipe joint 40 to an off-line drill pipe elevator 46. The off-line drill pipe elevator 46 is then raised by either a winch located in mast 20 or located on the rig floor of rig structure 10, or by a bridge trolley (shown as 205 in FIG. 1) mounted on an elevated platform attached to mast 20.

Third pipe joint 40 is then positioned above the pipe joints 40 in pivoting section 60 (which is in the vertical position) that is closest to off-line roughneck 100. The third pipe joint 40 is then lowered via the off-line drill pipe elevator such that the lower end of the third pipe joint 40 engages one of the vertically held pipe joints 40. Off-line roughneck 100 is then moved forward toward pivoting section 60 until it reaches the engaged pipe joints 40. The upper tongs of off-line roughneck 100 "grab" the bottom portion of the third pipe joint (which is held in place by the off-line drill pipe elevator), while the lower tongs of off-line roughneck 100 "grab" the top portion of the engaged pipe joint 40 held in the vertical position within pivoting section 60. Off-line roughneck 100 is then used to apply the necessary rotation to the engaged pipe joints 40 for the initial make-up of the connection and to apply the necessary final make-up torque to the threaded connection. One of skill in the art will appreciate that numerous movable or "extendable" iron roughnecks exist that can be used for off-line roughneck 100 in the present invention, one such roughneck being National-Oilwell's IR30-80 Roughneck.

After off-line roughneck 100 makes-up the connection, it is disengaged from the pipe joints 40, and the off-line drill pipe elevator is used to lift the connected pipe joints 40 above platform 105. The connected pipe joints 40 are then positioned above the remaining pipe joint 40 held in the vertical position within pivoting section 60. The lower end of the connected pipe joints 40 is then lowered via the off-line drill pipe elevator such that the lower end of the connected pipe joints 40 engages the remaining vertically held pipe joint 40. Off-line roughneck 100 is then moved forward toward pivoting section 60 until it reaches the engaged pipe joints 40. The upper tongs of off-line roughneck 100 "grab" the bottom portion of the connected pipe joints (which are held in place by the off-line drill pipe elevator), while the lower tongs of off-line roughneck 100 "grab" the top portion of the engaged pipe joint 40 held in the vertical position within pivoting section 60. Off-line roughneck 100 is then used to apply the necessary rotation to the engaged pipe joints 40 for the initial make-up of the connection and to apply the necessary final make-up torque to the threaded connection.

After the three pipe joints 40 are connected together as described in the preceding paragraphs, off-line roughneck 100 releases the connected joints of drill pipe, and the stand of drill pipe—now measuring 90 feet in length—is moved into position for storage in racking board 200 (shown in FIG. 1) through use of the off-line drill pipe elevator.

In a similar manner as just described, a 60-foot drill pipe stand can be assembled. For a 60-foot stand, only one pipe joint 40 is rolled onto pivoting section 60 of V-door ramp 50 and pivoted downwardly until it is in a vertical position. The pipe joint 40 held in the vertical position in pivoting section 60 can then be attached to a second pipe joint 40 lifted directly from the stationary section 55 of V-door ramp 50 in the manner described above. For drilling rigs designed to only handle 60-foot drill pipe stands, pivoting section 60 of V-door ramp 50 can be designed to hold only one pipe joint 40.

Again, in a similar manner as described with respect to a 90-foot drill pipe stand, a fourth pipe joint 40 can be attached to the 90-foot drill pipe stand to form a 120-foot drill pipe stand. To form a 120-foot stand of drill pipe, a fourth pipe joint 40 is rolled onto pivoting section 60 of V-door ramp 50 and pivoted downwardly until it is in the vertical position. The pipe joint 40 held in the vertical position in pivoting section 60 can then be attached to the three pipe joint section that has been previously made up in the manner described above with respect to the 90-foot drill pipe stand. The 120-foot drill pipe stand can than be moved into position for storage in racking board 210 (shown in FIG. 1) through use of the off-line drill pipe elevator.

Figure 5:
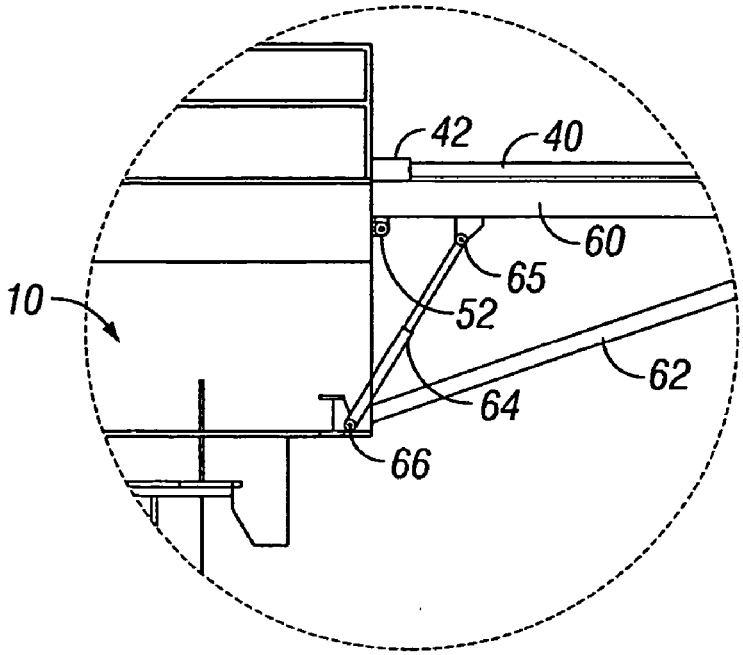
FIG. 5 is a detailed side view of the pivoting section of the V-door ramp according to one embodiment of the present invention showing the support cylinder connected between the drilling rig structure and the pivoting section of the V-door ramp in the extended position whereby the pivoting section of the V-door ramp is in the horizontal position.
Figure 6:
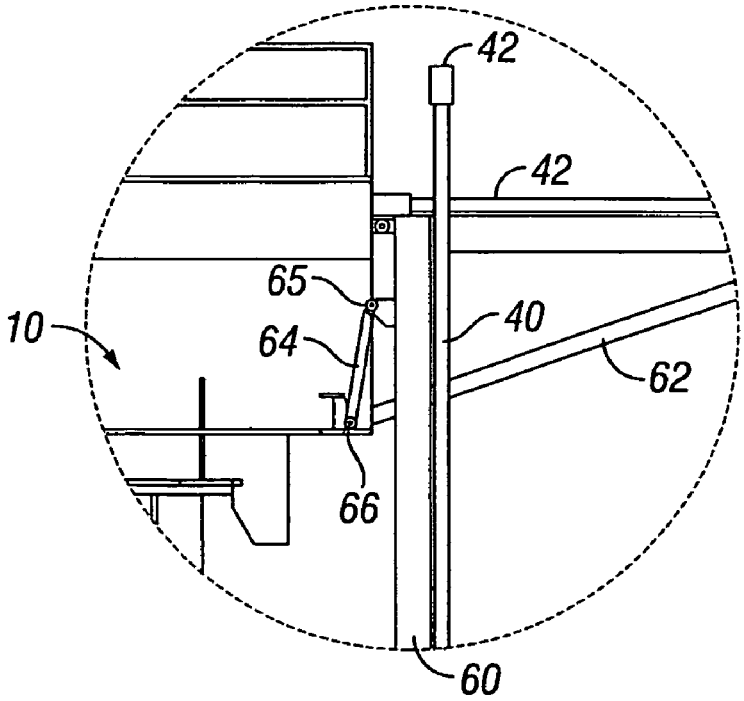
FIG. 6 is a detailed side view of the pivoting section of the V-door ramp according to one embodiment of the present invention showing the support cylinder connected between the drilling rig structure and the pivoting section of the V-door ramp in the retracted position whereby the pivoting section of the V-door ramp is in the vertical position.

Referring now to FIGS. 5 and 6, the pivoting mechanism of pivoting section 60 is shown in more detail. In the preferred embodiment of the present invention, pivoting section 60 is connected to rig structure 10 via pin connection 52. Pin connection 52 allows pivoting section 60 to rotate downwardly while remaining connected to rig structure 10. Similar pin connections 65 and 66 are used to connect support cylinder 64 to pivoting section 60 and rig structure 10 respectively.

In FIG. 5, pivoting section 60 is shown in the horizontal position. In this position, support cylinder 64 is in the fully extended position. To "pivot" pivoting section 60 downwardly, support cylinder 64 is slowly retracted. As support cylinder 64 is retracted, pivoting section 60 rotates about pin connector 52 and begins to lower toward the vertical position shown in FIG. 6. As support cylinder 64 continues to retract, support cylinder 64 is allowed to rotate about its connection points to the pivoting section 60 (via pin connection 65) and the rig structure 10 (via pin connection 66) such that pin connection 65 forces support cylinder 64 toward rig structure 10. In the preferred embodiment, support cylinder 64 is specifically sized to be fully retracted (or "bottomed out") when pivoting section 60 is in the vertical position, as shown in FIG. 6.

From the preceding description of the pivoting pipe handler of the present invention, one of skill in the art will appreciate that the present invention significantly reduces the amount of pipe handling required to assemble drill pipe stands off-line. This reduction in pipe handling allows for a more efficient and safer off-line make-up operation. Further, it will be appreciated that the pivoting V-door ramp section of the present invention alleviates the need for the "off-line holes" used in the prior art, thereby removing another safety concern found in the prior art.

Moreover, although the present invention has been described with reference to the off-line make-up of drill pipe stands, one of skill in the art will appreciate that the present invention can be adapted for off-line make-up of stands of different types of oilfield tubulars, including drill pipe stands, casing stands, liner stands, and/or production tubing.

While the apparatus, compositions and methods of this invention have been described in terms of preferred or illustrative embodiments, it will be apparent to those of skill in the art that variations may be applied to the apparatus and methods described herein without departing from the concept and scope of the invention. All such similar substitutes and modifications apparent to those skilled in the art are deemed to be within the scope and concept of the invention as it is set out in the following claims.

The invention claimed is:

1. A system for off-line make-up of joints of oilfield tubulars on a drilling rig structure comprising:

a V-door ramp connected to the drilling rig structure, the V-door ramp having a stationary section and a pivoting section, wherein the pivoting section is adapted to pivot between a first position and a second position;

at least one support cylinder having a first end and a second end, wherein the first end is pivotally connected to the drilling rig structure and the second end is pivotally connected to the pivoting section of the V-door ramp;

a holding means for securing at least one tubular joint in the pivoting section of the V-door ramp when the pivoting section is in the second position; and a positioning cylinder connected to the pivoting section of the V-door ramp, wherein the positioning cylinder is adapted for positioning the at least one tubular joint in the pivoting section.

2. The system of claim 1 wherein the pivoting section of the V-door ramp is in line with the stationary section of the V-door ramp in the first position.

3. The system of claim 2 wherein the at least one support cylinder is in an extended position when the pivoting section of the V-door ramp is in the first position.

4. The system of claim 1 wherein the pivoting section of the V-door ramp is in a substantially vertical position in the second position.

5. The system of claim 4 wherein the at least one support cylinder is in a fully retracted position when the pivoting section of the V-door ramp is in the second position.

6. The system of claim 1 wherein the holding means comprises a bar hingedly connected to the pivoting section of the V-door ramp and a latching mechanism.

7. The system of claim 6 wherein the bar of the holding means is moved from a first position in which the pivoting section of the V-door ramp is able to receive the at least one tubular joint to a second position in which the bar engages the latching mechanism to secure the at least one tubular joint in the pivoting section of the V-door ramp when the pivoting section is in the second position.

8. The system of claim 1 wherein the first end of the at least one support cylinder is pivotally connected to the drilling rig structure by a pin connection.

9. The system of claim 1 wherein the second end of the at least one support cylinder is pivotally connected to the pivoting section of the V-door ramp by a pin connection.

10. The system of claim 1 further comprising an elevated platform having an iron roughneck mounted thereon.

11. The system of claim 1 further comprising a tubular elevator.

12. The system of claim 11 wherein the tubular elevator is raised or lowered by a winch.

13. The system of claim 11 wherein the tubular elevator is raised or lowered by a bridge trolley connected to an elevated platform that is connected to a mast of the drilling rig structure.

14. The system of claim 1 further comprising at least one racking board connected to the mast of the drilling rig structure, the at least one racking board adapted for storing offline a stand of tubulars consisting of multiple tubulars joined together.

15. The system of claim 1 further comprising at least one support member extending from the drilling rig structure to the stationary section of the V-door ramp.

16. A system for off-line make-up of joints of oilfield tubulars on a drilling rig structure comprising:

a V-door ramp connected to the drilling rig structure, the V-door ramp having a stationary section and a pivoting section, wherein the stationary section supports at least one tubular joint and the pivoting section supports at least one tubular joint and is pivotable with respect to the drilling rig structure;

at least one support cylinder having a first end and a second end, wherein the first end is pivotally connected to the drilling rig structure and the second end is pivotally connected to the pivoting section of the V-door ramp;

a holding mechanism comprising a bar hingedly connected to the pivoting section of the V-door ramp and a latching mechanism, wherein the bar and latching mechanism cooperate to secure the at least one tubular joint in the pivoting section;

a positioning cylinder connected to the pivoting section of the V-door ramp, wherein the positioning cylinder is adapted to position the at least one tubular joint in the pivoting section;

a tubular elevator for raising or lowering at least one tubular joint;

a movable iron roughneck, wherein the movable iron roughneck can be extended such that it grabs one of the at least one tubular joints supported by the tubular elevator and one of the at least one tubular joints in the pivoting section of the V-door ramp; and at least one racking board, wherein the at least one racking board is connected to a mast of the drilling rig structure.

17. The system of claim 16 wherein the pivoting section of the V-door ramp is in line with the stationary section of the V-door ramp when the at least one support cylinder is in an extended position.

18. The system of claim 16 wherein the pivoting section of the V-door ramp is in a substantially vertical position when the at least one support cylinder is in a fully retracted position.

19. The system of claim 16 wherein the bar of the holding mechanism is moved from a first position in which the pivoting section of the V-door ramp is able to receive the at least one tubular joint to a second position in which the bar engages the latching mechanism to secure the at least one tubular joint in the pivoting section of the V-door ramp when the pivoting section is in the substantially vertical position.

20. The system of claim 16 wherein the first end of the at least one support cylinder is pivotally connected to the drilling rig structure by a pin connection.

21. The system of claim 16 wherein the second end of the at least one support cylinder is pivotally connected to the pivoting section of the V-door ramp by a pin connection.

22. The system of claim 16 wherein the movable iron roughneck is mounted on an elevated platform.

23. The system of claim 16 wherein the tubular elevator is raised or lowered by a winch.

24. The system of claim 16 wherein the tubular elevator is raised or lowered by a bridge trolley connected to an elevated platform that is connected to the mast of the drilling rig structure.

25. The system of claim 16 wherein the at least one racking board is adapted for storing offline a tubular stand consisting of multiple tubular joints joined together.

26. The system of claim 16 further comprising at least one support member extending from the drilling rig structure to the stationary section of the V-door ramp.

27. A system for off-line make-up of oilfield tubulars comprising:

a V-door ramp connected to a drilling rig structure, the V-door ramp having a stationary section and a pivoting section, wherein the pivoting section is adapted to pivot from a first position to a second position;

at least one support cylinder having a first end and a second end, wherein the first end is pivotally connected to the drilling rig structure and the second end is pivotally connected to the pivoting section of the V-door ramp;

a holding mechanism adapted to secure at least one tubular joint in the pivoting section of the V-door ramp when the pivoting section is in the second position; and a positioning cylinder connected to the pivoting section of the V-door ramp, wherein the positioning cylinder is adapted for positioning the at least one tubular joint in the pivoting section.

28. A method for off-line make-up of oilfield tubulars on a drilling rig structure comprising:

providing a V-door ramp that is connected to the drilling rig structure, the V-door ramp having a pivoting section and a stationary section;

supporting at least two tubular joints on the stationary section of the V-door ramp;

moving at least one of the at least two tubular joints to the pivoting section of the V-door ramp;

securing the at least one tubular joint on the pivoting section of the V-door ramp;

pivoting the pivoting section of the V-door ramp from a first position to a second position;

raising one of the at least two tubular joints supported on the stationary section of the V-door ramp such that the tubular joint is positioned above the pivoting section of the V-door ramp; and connecting the tubular joint secured on the pivoting section of the V-door ramp to the tubular joint raised above the pivoting section of the V-door ramp to create a tubular stand.

29. The method of claim 28 further comprising moving the tubular stand to a racking board adapted for storing the tubular stand, wherein the racking board is connected to a mast of the drilling rig structure.

30. The method of claim 28 further comprising extending or retracting a positioning cylinder connected to the pivoting section of the V-door ramp to position the at least one tubular joint within the pivoting section.

31. The method of claim 28 wherein the pivoting section of the V-door ramp is pivoted to the second position by retracting a support cylinder having a first end connected to the drilling rig structure and a second end connected to the pivoting section.

32. The method of claim 28 wherein the tubular joint is raised from the stationary section of the V-door ramp to a position above the pivoting section of the V-door ramp by connecting a tubular elevator to the tubular joint and raising the tubular elevator.

33. The method of claim 32 wherein the tubular elevator is raised or lowered by a winch.

34. The method of claim 32 wherein the tubular elevator is raised or lowered by a bridge trolley connected to an elevated platform that is connected to a mast of the drilling rig structure.

35. The method of claim 32 further comprising engaging one of the at least one tubular joints secured in the pivoting section of the V-door ramp and engaging the tubular joint raised above the pivoting section with an iron roughneck.

36. The method of claim 35 further comprising operating the iron roughneck to make-up the connection between the tubular joints engaged by the iron roughneck.

37. A method for off-line make-up of oilfield tubulars on a drilling rig structure comprising:

providing a V-door ramp that is connected to the drilling rig structure, the V-door ramp having a pivoting section and a stationary section;

supporting a plurality of tubular joints on the stationary section of the V-door ramp;

moving at least two of the plurality of tubular joints to the pivoting section of the V-door ramp;

securing the at least two tubular joints on the pivoting section of the V-door ramp;

pivoting the pivoting section of the V-door ramp from a first position to a second position, wherein the pivoting section is in a substantially vertical position in the second position;

raising one of the plurality of tubular joints supported on the stationary section of the V-door ramp such that the tubular joint is in a substantially vertical position above the pivoting section of the V-door ramp;

connecting one of the at least two tubular joints secured on the pivoting section of the V-door ramp to the tubular joint raised above the pivoting section of the V-door ramp to create a two-tubular stand;

raising the two-tubular stand such that the two-tubular stand is in a substantially vertical position above the pivoting section of the V-door ramp;

connecting one of the at least two tubular joints secured on the pivoting section of the V-door ramp to the two-tubular stand raised above the pivoting section to create a three-tubular stand.

38. The method of claim 37 further comprising moving the three-tubular stand to a racking board adapted for storing the tubular stand, wherein the racking board is connected to a mast of the drilling rig structure.

39. The method of claim 37 further comprising extending or retracting a positioning cylinder connected to the pivoting section of the V-door ramp to position the tubular joints within the pivoting section.

40. The method of claim 37 wherein the pivoting section of the V-door ramp is pivoted by retracting a support cylinder having a first end connected to the drilling rig structure and a second end connected to the pivoting section.

41. The method of claim 37 wherein the tubular joint is raised from the stationary section of the V-door ramp to a position above the pivoting section of the V-door ramp by connecting the tubular joint to a tubular elevator and raising the tubular elevator.

42. The method of claim 37 wherein the two-tubular stand is raised to a position above the pivoting section of the V-door ramp by raising the tubular elevator.

43. The method of claim 42 wherein the tubular elevator is raised or lowered by a winch.

44. The method of claim 42 wherein the tubular elevator is raised or lowered by a bridge trolley connected to an elevated platform that is connected to a mast of the drilling rig structure.

45. The method of claim 37 further comprising engaging one of the at least two tubular joints secured in the pivoting section of the V-door ramp and engaging the tubular joint raised above the pivoting section with an iron roughneck.

46. The method of claim 45 further comprising operating the iron roughneck to make-up the connection between the tubular joints engaged by the iron roughneck to create the two-tubular stand.

47. The method of claim 46 further comprising engaging one of the at least two tubular joints secured in the pivoting section of the V-door ramp and one of the tubular joints comprising the two-tubular stand with an iron roughneck.

48. The method of claim 47 further comprising operating the iron roughneck to make-up the connection between the tubular joints engaged by the iron roughneck to create the three-tubular stand.

49. A method for off-line make-up of joints of oilfield tubulars on a drilling rig structure comprising:

providing a V-door ramp that is connected to the drilling rig structure, the V-door ramp having a pivoting section and a stationary section;

supporting at least two tubular joints on the stationary section of the V-door ramp;

supporting at least one tubular joint on the pivoting section of the V-door ramp;

securing the at least one tubular joint on the pivoting section of the V-door ramp;

pivoting the pivoting section of the V-door ramp from a first position to a second position;

raising one of the at least two tubular joints supported on the stationary section of the V-door ramp such that the tubular joint is positioned above the pivoting section of the V-door ramp; and connecting the tubular joint secured on the pivoting section of the V-door ramp to the tubular joint raised above the pivoting section of the V-door ramp to create a tubular stand.

50. A method of handling joints of oilfield tubulars offline comprising:

providing a V-door ramp that is connected to the drilling rig structure, the V-door ramp having a pivoting section and a stationary section;

supporting at least two tubular joints on the stationary section of the V-door ramp;

supporting at least one tubular joint on the pivoting section of the V-door ramp;

securing the at least one tubular joint on the pivoting section of the V-door ramp;

pivoting the pivoting section of the V-door ramp from a first position to a second position.

* * * * *